US006241591B1

(12) United States Patent
Jackson et al.

(10) Patent No.: US 6,241,591 B1
(45) Date of Patent: Jun. 5, 2001

(54) APPARATUS AND METHOD FOR POLISHING A SUBSTRATE

(75) Inventors: Paul D. Jackson, Paradise Valley; E. Terry Lisi, Scottsdale; Lee A. Reeves, Gilbert, all of AZ (US)

(73) Assignee: Prodeo Technologies, Inc., Tempe, AZ (US)

( * ) Notice: Subject to any disclaimer, the term of this patent is extended or adjusted under 35 U.S.C. 154(b) by 0 days.

(21) Appl. No.: 09/418,819

(22) Filed: Oct. 15, 1999

(51) Int. Cl.[7] ..... B24B 5/00; B24B 29/00

(52) U.S. Cl. ..... 451/287; 451/288; 451/398

(58) Field of Search ..... 451/41, 42, 285, 451/286, 287, 288, 289, 364, 388, 397, 398, 402, 390

(56) References Cited

U.S. PATENT DOCUMENTS

| | | | | |
|---|---|---|---|---|
| 4,141,180 | | 2/1979 | Gill et al. . | |
| 4,811,522 | | 3/1989 | Gill . | |
| 5,081,795 | | 1/1992 | Tanaka et al. . | |
| 5,205,082 | | 4/1993 | Shendon et al. . | |
| 5,230,184 | | 7/1993 | Bukhman . | |
| 5,232,875 | | 8/1993 | Tuttle et al. . | |
| 5,267,418 | | 12/1993 | Currie et al. . | |
| 5,423,716 | | 6/1995 | Strasbaugh . | |
| 5,584,751 | | 12/1996 | Kobayashi et al. . | |
| 5,624,299 | | 4/1997 | Shendon . | |
| 5,643,061 | * | 7/1997 | Jackson et al. | 451/289 |
| 5,820,448 | | 10/1998 | Shamouilian et al. . | |
| 5,851,140 | | 12/1998 | Barns et al. . | |
| 5,857,899 | * | 1/1999 | Volodarsky et al. | 451/72 |
| 6,068,548 | * | 5/2000 | Vote et al. | 451/398 |

* cited by examiner

*Primary Examiner*—Derris H. Banks
(74) *Attorney, Agent, or Firm*—Kent J. Cooper; Kevin B. Jackson

(57) ABSTRACT

In one embodiment, a polishing apparatus (10) includes a retaining ring (12), a pressure ring (16), a first seal (18), and a second seal (20). The retaining ring (12) is movably attached to the pressure ring (16) to create a uniform pressure distribution across the retaining ring (12). In addition a positive fluid pressure is applied to the first seal (18) and the second seal (20) to create the uniform pressure distribution across the retaining ring (12). The uniform pressure distribution across the retaining ring (16) allows a semiconductor substrate (51), polished with the polishing apparatus (10), to have a reduced edge exclusion, and thus increased die yield.

43 Claims, 10 Drawing Sheets

APPARATUS AND METHOD FOR POLISHING A SUBSTRATE

BACKGROUND OF THE INVENTION

This invention relates generally to semiconductor device processing, and more specifically to polishing apparatus and methods for polishing a semiconductor substrate.

Polishing processes, and more specifically chemical-mechanical polishing processes, have been used in the semiconductor industry to prepare both single crystal substrates and silicon on insulator substrates. In addition, chemical-mechanical polishing processes have also been used to planarize various conductive and insulating layers subsequently deposited on these substrates, during the integrated circuit fabrication process. For example, chemical-mechanical polishing has been used to planarize interlevel dielectric layers that lie in between two different levels of metal interconnect.

Planarizing the interlevel dielectric layer, prior to the formation of the next level of interconnect, is highly desirable because it allows the next level of interconnect to be subsequently patterned and etched without the formation of conductive metal stringers, which can electrically short adjacent metal lines, and without the formation of thinned or notched metal lines, which can adversely effect device reliability. Similarly, chemical-mechanical polishing has been used to planarize conductive materials, such as tungsten, copper, and aluminum, to form planar contact plugs, via plugs, and interconnects. In addition, chemical-mechanical polishing has also been used to form trench isolation. In this process, trenches are formed and then subsequently filled with a deposited dielectric layer, such as silicon dioxide.

The dielectric layer is then polished back to form dielectric filled isolation trenches, which are nearly planar with the adjacent active regions. In addition to being planar, the resulting trench isolation is also desirable because it allows the space separating adjacent active regions to be minimized, and thus allows integrated circuits with high device packing densities to be fabricated.

Unfortunately, the conductive and dielectric layers formed on the semiconductor substrate during the integrated circuit fabrication process often cannot be uniformly and economically polished with current polishing equipment and processes. Specifically, portions of the conductive and dielectric layers which lie near the edge of the semiconductor substrate are often under-polished or over-polished, and therefore semiconductor die located in this area, which is known as the edge exclusion, are often lost. These die represent a substantial revenue loss to integrated circuit manufacturers.

It is known in the prior art to use an independently controlled retaining ring to reduce edge exclusion area. However, prior art approaches use complex mechanical arrangements with custom designed seals and sealing arrangements such as diaphragms, bellows, or air bladders. These configurations are costly, require complex control arrangements, and are difficult to assemble. In addition, these configurations can generate non-uniform pressures on a retaining ring due to geometric constraints and/or mechanical stresses, which result from, for example, attachments or deflections. Moreover, these configurations utilize materials and methods that depart from established practices, which require end users to endure costly and lengthy qualification efforts.

Accordingly, a need exists for a lower cost polishing apparatus and polishing process that can polish semiconductor substrates with a reduced edge exclusion in order to increase die yields. Further, it would be beneficial for such apparatus and processes to use materials and methods that do not require extensive qualification or re-qualification efforts by the end-user.

DETAILED DESCRIPTION OF A PREFERRED EMBODIMENT

In general, the present invention pertains to a polishing apparatus having a pair of seals, each having a sealing lip. One seal forms a pressure seal with a pressure ring structure, and the other seal forms a pressure seal with a housing structure adjacent to the pressure ring structure. In a preferred embodiment, the pair of seals comprise a simple, commercial design. A retaining ring is coupled to the pressure ring structure. Together, the pair of seals, the pressure ring structure, and the housing structure provide a simplified and robust design for independent pressure control of the retaining ring.

Figure 1:
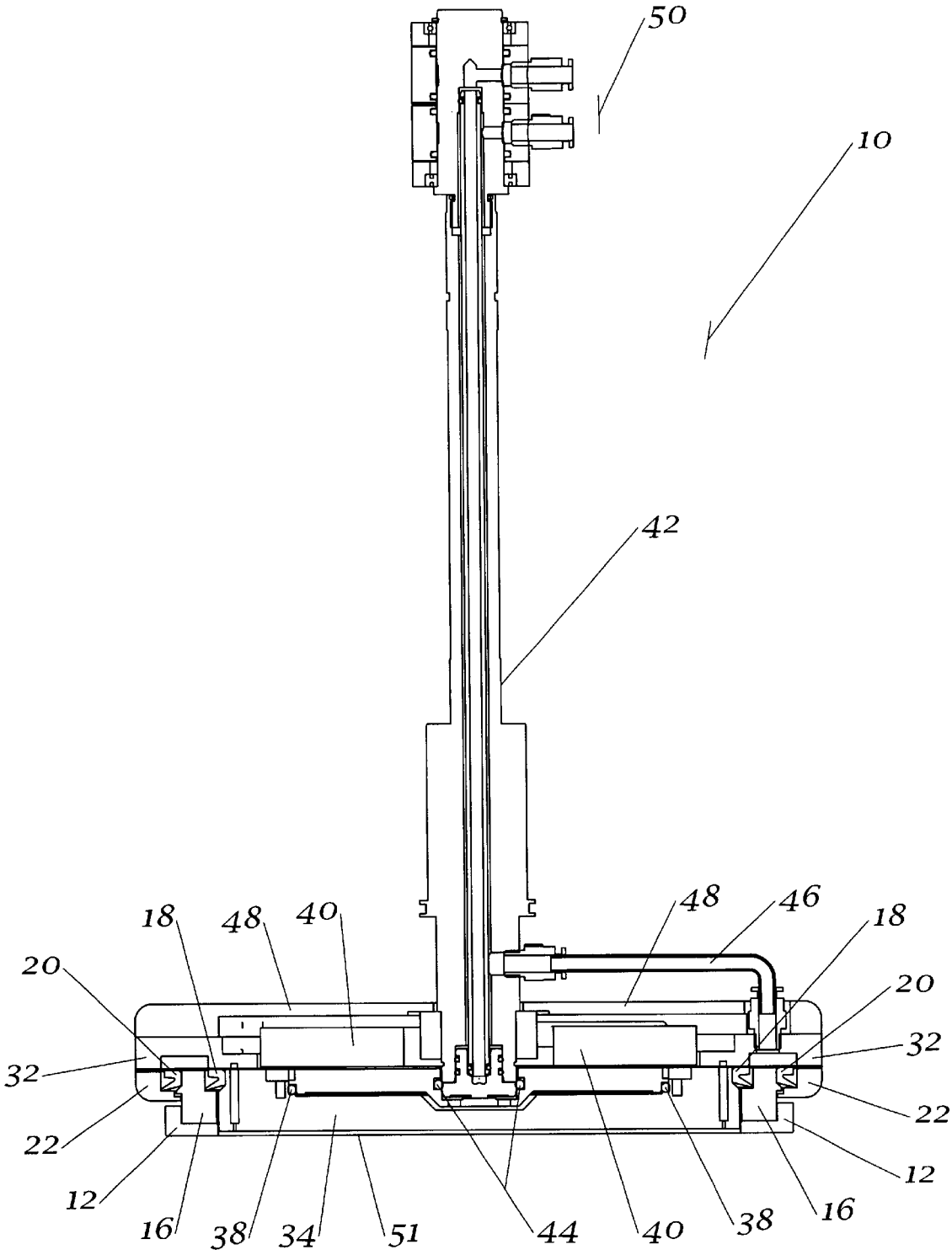
FIG. 1 illustrates, in cross section, a polishing apparatus in accordance with one embodiment of the invention.

FIG. 1 illustrates, in cross section, a polishing apparatus 10, which is in accordance with one embodiment of the present invention. In this particular embodiment, polishing apparatus 10 comprises a retaining ring 12, retaining ring fasteners 14 (as illustrated in FIG. 2), a pressure ring 16, a seal 18, a seal 20, a lower housing 22, a gasket 24 (as illustrated in FIG. 2), a torque flexure 26 (as illustrated in FIG. 2), a gasket 28 (as illustrated in FIG. 2), a gasket 30 (as illustrated in FIG. 2), an upper housing 32, a carrier 34, an adapter plate 36, a seal 38, a drive plate 40, a spindle shaft 42, a seal 44, a fluid line 46, a cover plate 48, and a rotary fluid coupling 50.

In FIG. 1, a semiconductor substrate 51 is also shown mounted to polishing apparatus 10. Note semiconductor substrate 51 is mounted to polishing apparatus 10, such that the front surface of semiconductor substrate 51 is substantially parallel with the front surface of retaining ring 12. It should be appreciated that semiconductor substrate 51 may be mounted to polishing apparatus 51, such that a carrier film (not shown) lies between carrier 34 and the back surface of semiconductor substrate 51.

Figure 2:
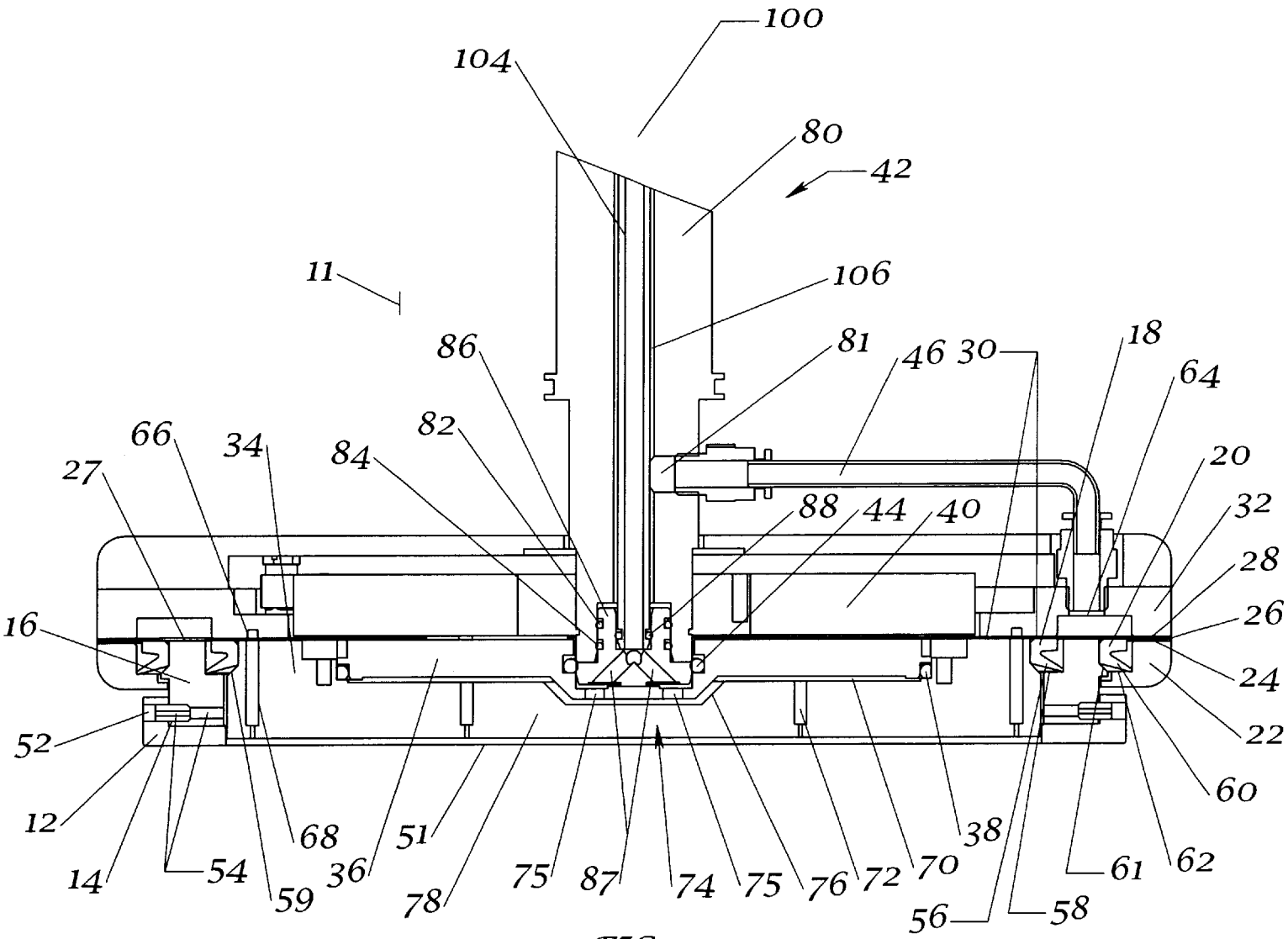
FIG. 2 illustrates, in cross section, a portion of the polishing apparatus illustrated in FIG. 1, which is in accordance with one embodiment of the invention.

FIG. 2 illustrates, in cross section, a portion 11 of polishing apparatus 10. As shown in FIG. 2, retaining ring 12 has a plurality of openings 52 formed therein, which extend through a portion of retaining ring 12. Note retaining ring 12 is used to retain semiconductor substrate 51 adjacent to carrier 34 during polishing, as shown in FIG. 1. Pressure ring 16 also has a plurality of openings 54 formed therein, which align with openings 52 of retaining ring 12. In one embodiment, openings 54 are partially threaded and extend through a portion of pressure ring 16, as shown in FIG. 2.

Retaining ring fasteners 14 are used in conjunction with openings 52 and openings 54 to attach retaining ring 12 to pressure ring 16. In a preferred embodiment, openings 52 have a opening width or diameter which is bigger than the largest width or diameter of retaining ring fasteners 14. This configuration allows retaining ring 12 to be movably attached to pressure ring 16, in that retaining ring 12 can move independently of pressure ring 16 even though it is attached to pressure ring 16 by retaining ring fasteners 14. In one embodiment, retaining ring 12 is movably attached to pressure ring 16 using headless fasteners, such as set screws, pins, dowels, or the like. In an alternative embodiment, retaining ring 12 is movably attached to pressure ring 16 using fasteners that have heads, such as screws, bolts, or the like.

It is important to note that a uniform pressure distribution must be formed across retaining ring 12 in order to achieve a small edge exclusion during polishing. In a preferred embodiment, retaining ring 12 is movably attached to pressure ring 16, and thus retaining ring fasteners 14 do not apply clamp-up stress, force or pressure to retaining ring 12. As a result, retaining ring 12 is not deformed, which allows a uniform pressure distribution to be formed across retaining ring 12. Thus, unlike the prior art, the present invention allows semiconductor substrates to be polished with reduced edge exclusion.

It is also important to note that if openings 54 extend through pressure ring 16, as shown in FIG. 2, then retaining ring fasteners 14 may also contain a vent or channel region (not shown) that allows gas or liquid trapped between polishing apparatus 10 and an underlying polishing pad to escape through openings 52. It should be appreciated that venting of the trapped liquid or gas ensures that substrate 51 contacts the underlying pad. In one embodiment, holes are drilled through each retaining ring fastener 14 to form the vent or channel regions.

Alternatively, pressure ring 16 and retaining ring 12 are formed as one contiguous piece to form an integrated retaining ring. In this case the integrated retaining ring would comprise a lip seal landing region similar to lip seal landing region 58, an over-travel-stop similar to over-travel-stop 61, and openings similar to threaded openings 54. In addition, the integrated retaining ring could also have openings extending through it to allow venting of trapped gas or liquid, as previously described above.

Seal 18 forms a pressure seal with pressure ring 16 when positive fluid pressure is applied to seal 18. In this particular embodiment, seal 18 abuts the perimeter of carrier 34 to form a pressure seal with carrier 34, as shown in FIG. 2. In a preferred embodiment, seal 18 is a V-shaped seal with a sealing lip 56 that forms a pressure seal with lip seal landing region 58 of pressure ring 16 when positive fluid pressure is applied above sealing lip 56. Note, over-travel-stop 59 of carrier 34 is used to limit the movement of seal 18 during pressurization.

Seal 20 forms a pressure seal with lower housing 22 when positive fluid pressure is applied to seal 20. In this particular embodiment, seal 20 abuts the perimeter of pressure ring 16 to form a pressure seal with pressure ring 16, as shown in FIG. 2. In a preferred embodiment, seal 20 is a V-shaped seal with a sealing lip 60 that forms a pressure seal with lip seal landing region 62 of pressure ring 16 when positive fluid pressure is applied to sealing lip 60. Note, over travel stop 61 of pressure ring 16 is used to limit the movement of seal 20 during pressurization. It should be appreciated that seals 18 and 20 also may be a U-shaped seal, a W-shaped seal, a C-shaped seal, an E-shaped seal, or a flap seal. Seals 18 and 20 preferably are made of a flexible elastomeric material. For example, seals 18 and 20 may be made of Buna-N nitrile rubber or a fluorelastomer, like that sold under the "Viton" trademark.

It should be appreciated that the shape of seals 18 and 20 provides a pressure seal, and provides a reduced friction motion over a limited range for retaining ring 12 that is independent of carrier 40. However, even though seals 18 and 20 are effective over a specific range of motion, the specific range is more than sufficient to support or enable reduced edge exclusion polishing. Also, seals 18 and 20 are not fixedly attached to pressure ring 16 and lower housing 22, which reduces membrane or attachment stresses that would adversely affect a uniform pressure distribution. Additionally, seals 18 and 20 comprise commercially available designs, which provides for a simplified cost effective design.

Gasket 24 overlies lower housing 22 and underlies torque flexure 26. Gasket 24 forms a pressure seal between lower housing 22 and torque flexure 26. In one embodiment gasket 24 has an annular shape and is made of expanded polytetrafluoroethylene (PTFE). It should be appreciated that gasket 24 may also be formed using other materials that can form a pressure seal between two surfaces.

Torque flexure 26 is attached to pressure ring 16, upper housing 32 and lower housing 22. In one embodiment, torque flexure 26 is made of very thin stainless steel (e.g., 0.005 to 0.010 inches). During polishing, torque flexure 26 transfers torque from lower housing 22 and upper housing 32 to pressure ring 16, and also allows a reduced friction vertical motion. A preferred torque flexure 26 is more fully described in conjunction with FIG. 6.

Gasket 28 overlies torque flexure 26 and underlies upper housing 32 and forms a pressure seal between upper housing 32 and torque flexure 26. In one embodiment gasket 28 has an annular shape and is made of expanded PTFE. It should be appreciated that gasket 28 may also be formed using other materials that can form a pressure seal between two surfaces.

Gasket 30 lies between upper housing 32 and carrier 34 and forms a pressure and/or vacuum seal between upper housing 32 and carrier 34. In one embodiment gasket 30 has an annular shape and is made of expanded PTFE. It should be appreciated that gasket 30 may also be formed using other materials that can form a seal between two surfaces.

Upper housing 32 is attached to lower housing 22 and carrier 34. In one embodiment, upper housing 32 has an annular channel region 64 that overlies a portion of seal 18 and a portion of seal 20. Channel region 64 is coupled to fluid line 46, and during polishing it is used to supply a positive fluid pressure to seal 18 and seal 20. In one embodiment, upper housing 32 is made of stainless steel.

Carrier 34 lies adjacent to retaining ring 12 and pressure ring 16. Note, that torque flexure 26, seal 18 and seal 20 allow retaining ring 12 and pressure ring 16 to move independently of carrier 34. In this particular embodiment, carrier 34 has process hole openings 68, a recessed region 70, process hole openings 72, and a recessed region 74, which has a tapered sidewall 76. Process hole openings 68 and process hole openings 72 are used to apply a vacuum to the back surface of semiconductor substrate 51. In addition, process hole openings 68 and process hole openings 72 may be used to apply a positive fluid pressure to the back surface of semiconductor substrate 51. For example, process hole openings 68 and 72 are used to apply pressurized air or water to the back surface of semiconductor substrate 51. Channel region 66 of upper housing 32 overlies process hole openings 68, and is used to supply vacuum and/or positive fluid pressure to process hole openings 68. In one embodiment, carrier 34 is made of stainless steel. Other materials such as ceramics are suitable as well.

Adapter plate 36 has openings 75 formed therein, and is attached to carrier 34 such that a cavity 78 is formed between the bottom surface of the adapter plate 36 and the top surface of carrier 34. Cavity 78 is connected to process hole openings 72, and is used to supply vacuum and/or positive fluid pressure to process hole openings 72. In one embodiment, adapter plate 36 is made of stainless steel.

Seal 38 lies between adapter plate 36 and carrier 34, and forms a pressure and/or vacuum seal between adapter plate 36 and carrier 34. Seal 38 is preferably made of a flexible elastomeric material. For example, seal 38 may be made of Buna-N nitrile rubber or a fluorelastomer, like that sold under the "Viton" trademark.

Spindle shaft 42 overlies adapter plate 36 and is coupled to drive plate 40 such that torque from spindle shaft 42 is transferred to drive plate 40 and to carrier plate 34, which is coupled to drive plate 40. In one embodiment, spindle shaft 42 and adapter plate 36 mechanically transmit polishing down force to carrier plate 34 during processing.

Figure 9:
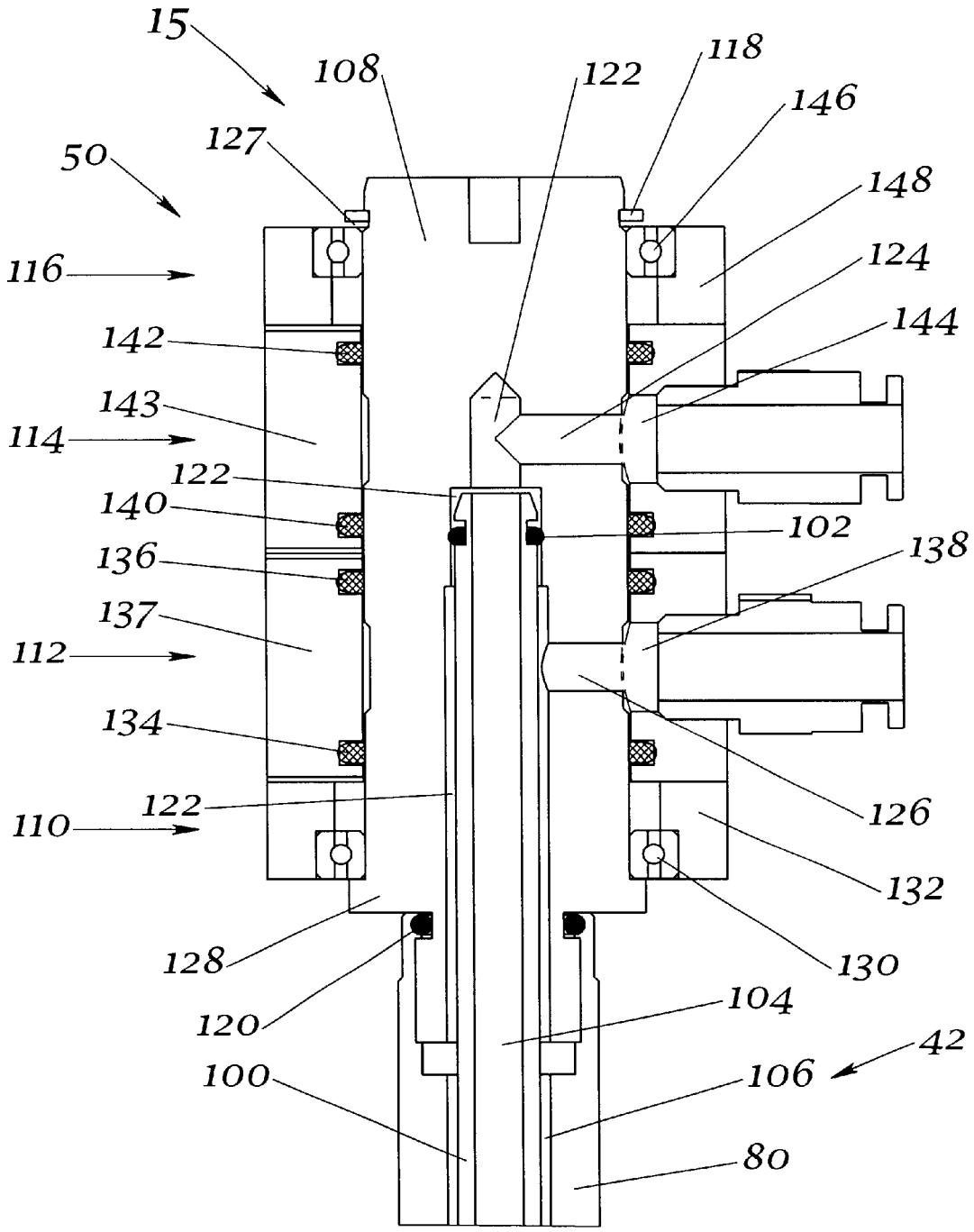
FIG. 9 illustrates, in cross section, a portion of the polishing apparatus illustrated in FIG. 1, which is in accordance with one embodiment of the invention.

In one embodiment, spindle shaft 42 includes an annular housing 80 having an outlet 81, a spindle plug 86 having seals 82 and 84, and a tube 100 having seals 88 and 102 (seal 102 is illustrated in FIG. 9).

Spindle plug 86 contains openings 87 and overlies adapter plate 36 and is adjacent to a first end of annular housing 80. Seal 82 and seal 84 lie between spindle plug 86 and annular housing 80, and form a pressure and/or vacuum seal between spindle plug 86 and annular housing 80. Tube 100 lies within annular housing 80, and a first end of tube 100 lies within a portion of spindle plug 86. Seal 88 lies between tube 100 and spindle plug 86 and forms a pressure and/or vacuum seal between spindle plug 86 and tube 100. In one embodiment, annular housing 80 and tube 100 are made of stainless steel, and spindle button 86 is preferably made of a chemically resistant material, such as polyphenylene sulfide or polyethylene terephthalate. Seals 82, 84, 88, and 102 preferably are made of a flexible elastomeric material. For example, the seals are be made of Buna-N nitrile rubber or a fluorelastomer, like that sold under the "Viton" trademark.

It is important to note that the interior of tube 100 forms a fluid conduit 104, and the region between the inner surface of annular housing 80 and the outer surface of tube 100 forms a fluid conduit 106, and in this particular embodiment fluid conduit 104 and fluid conduit 106 are coaxial with each other. Fluid conduit 104 is connected to cavity 78 by openings 87 in spindle plug 86 and openings 75 in adapter plate 36, and is used to apply vacuum and/or positive fluid pressure to the backside of semiconductor substrate 51.

Fluid conduit 106 is connected to channel region 64 by outlet 81 of annular housing 80 and fluid line 46, and is used to supply a positive fluid pressure to seals 18 and 20 during polishing. Note that in this particular embodiment, seal 18 forms a pressure seal with pressure ring 16, but not a vacuum seal. Similarly, seal 20 forms a pressure seal with lower housing 22, but not a vacuum seal. Therefore, in this particular embodiment fluid conduit 106 is used to supply a positive fluid pressure to seals 18 and 20, but is not used to apply a vacuum to seals 18 and 20.

It should be appreciated that spindle shaft 42 may also be formed such that fluid conduit 104 and fluid conduit 106 are not coaxial with each other. In addition, it should be appreciated that spindle shaft 42 may be formed with more than two separate fluid conduits.

Seal 44 lies between adapter plate 36 and spindle shaft 42, and forms a pressure and/or vacuum seal between adapter plate 36 and spindle shaft 42. Seal 44 is preferably made of a flexible elastomeric material. For example, seal 44 may be made of Buna-N nitrile rubber or a fluorelastomer, like that sold under the "Viton" trademark.

Figure 3:
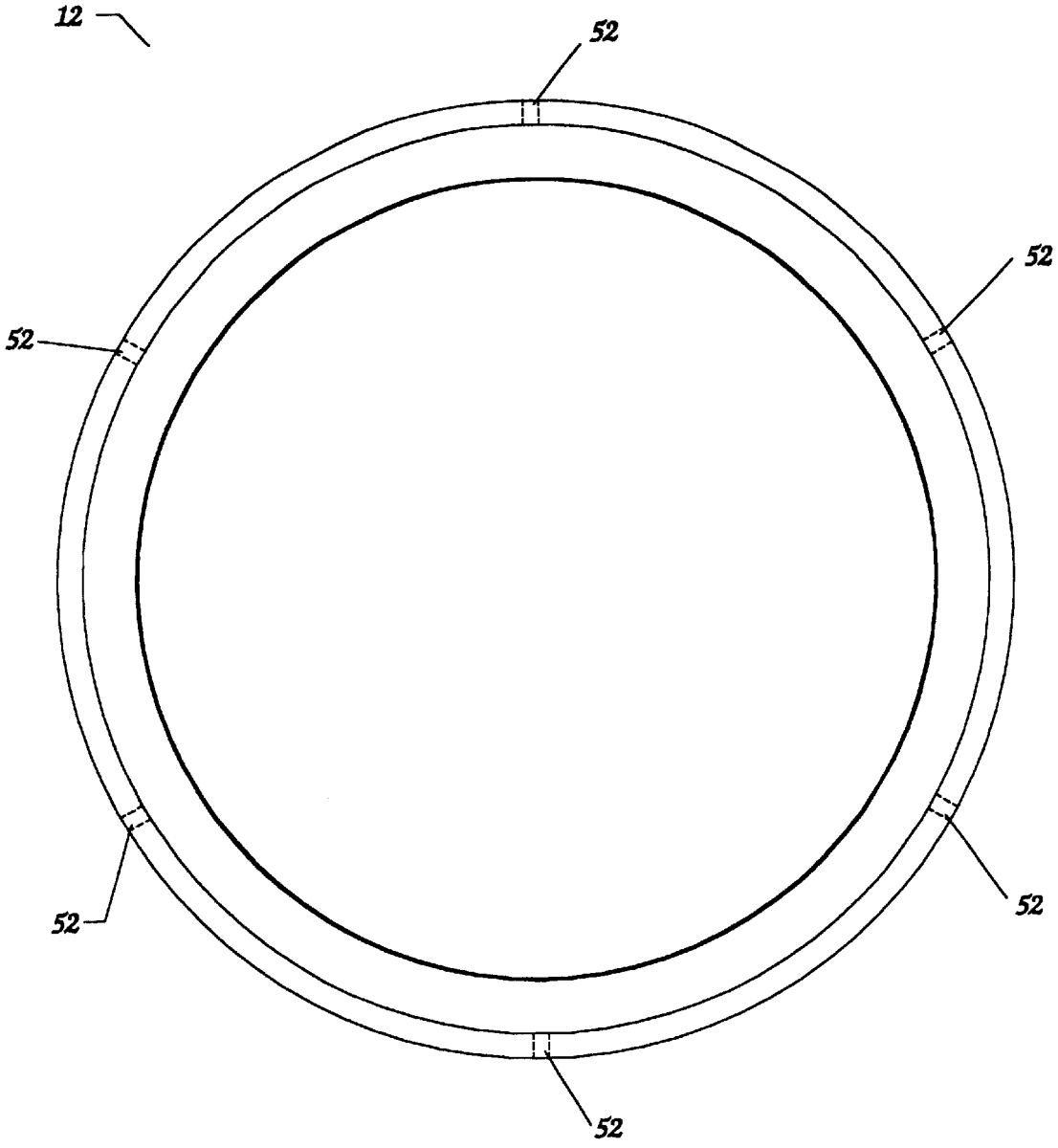
FIG. 3 illustrates, in plan view, a retaining ring in accordance with one embodiment of the invention.

FIG. 3 illustrates, in plan view, retaining ring 12 in accordance with one embodiment of the present invention. In this particular embodiment, retaining ring 12 contains six openings 52, which are used to attach retaining ring 12 to pressure ring 16. It should be appreciated that retaining ring 12 may have more than or less than six openings 52. Retaining ring 12 is preferably made of a chemically resistant material, such as polyethylene terephthalate or polyphenylene sulfide.

Figure 4:
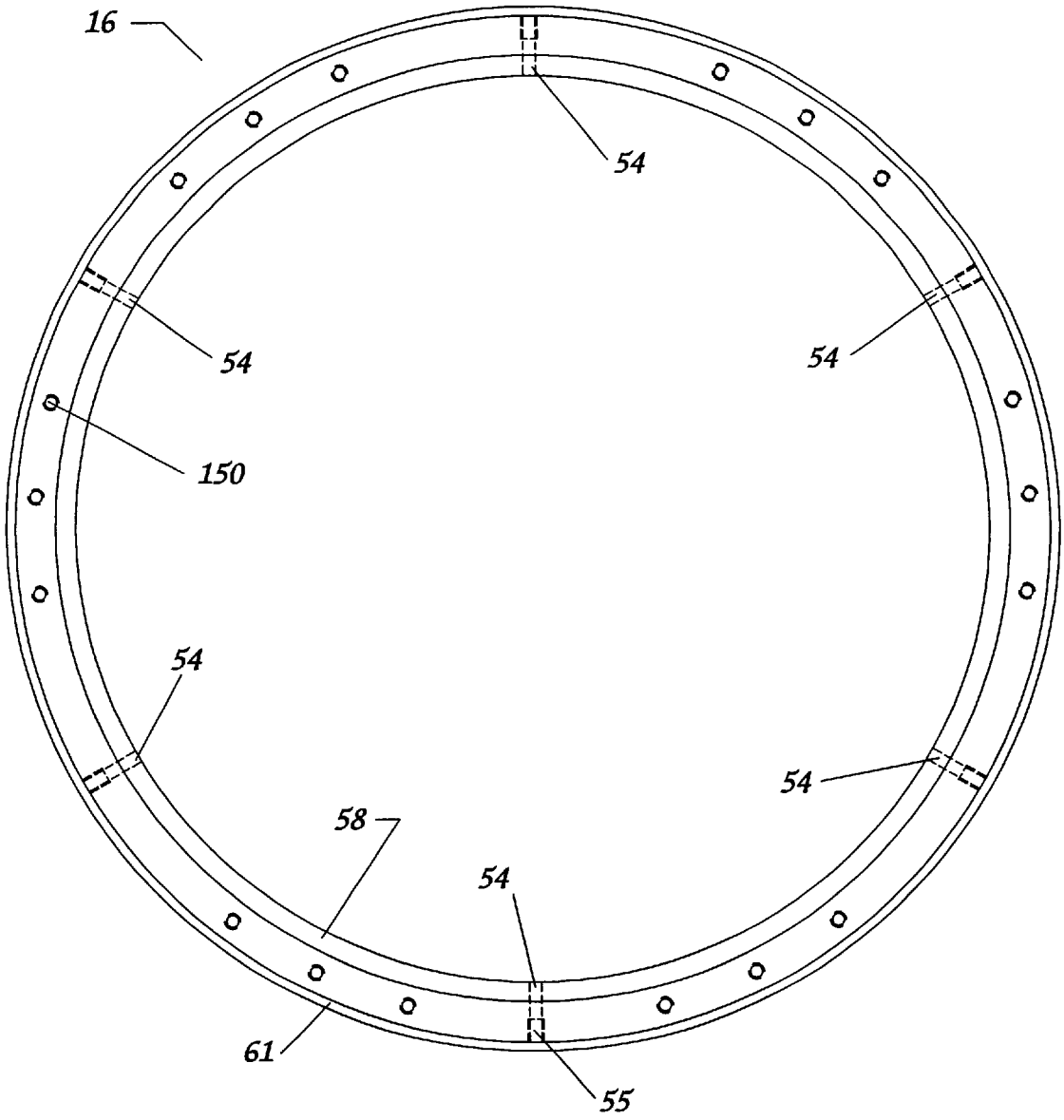
FIG. 4 illustrates, in plan view, a pressure ring in accordance with one embodiment of the invention.
Figure 5:
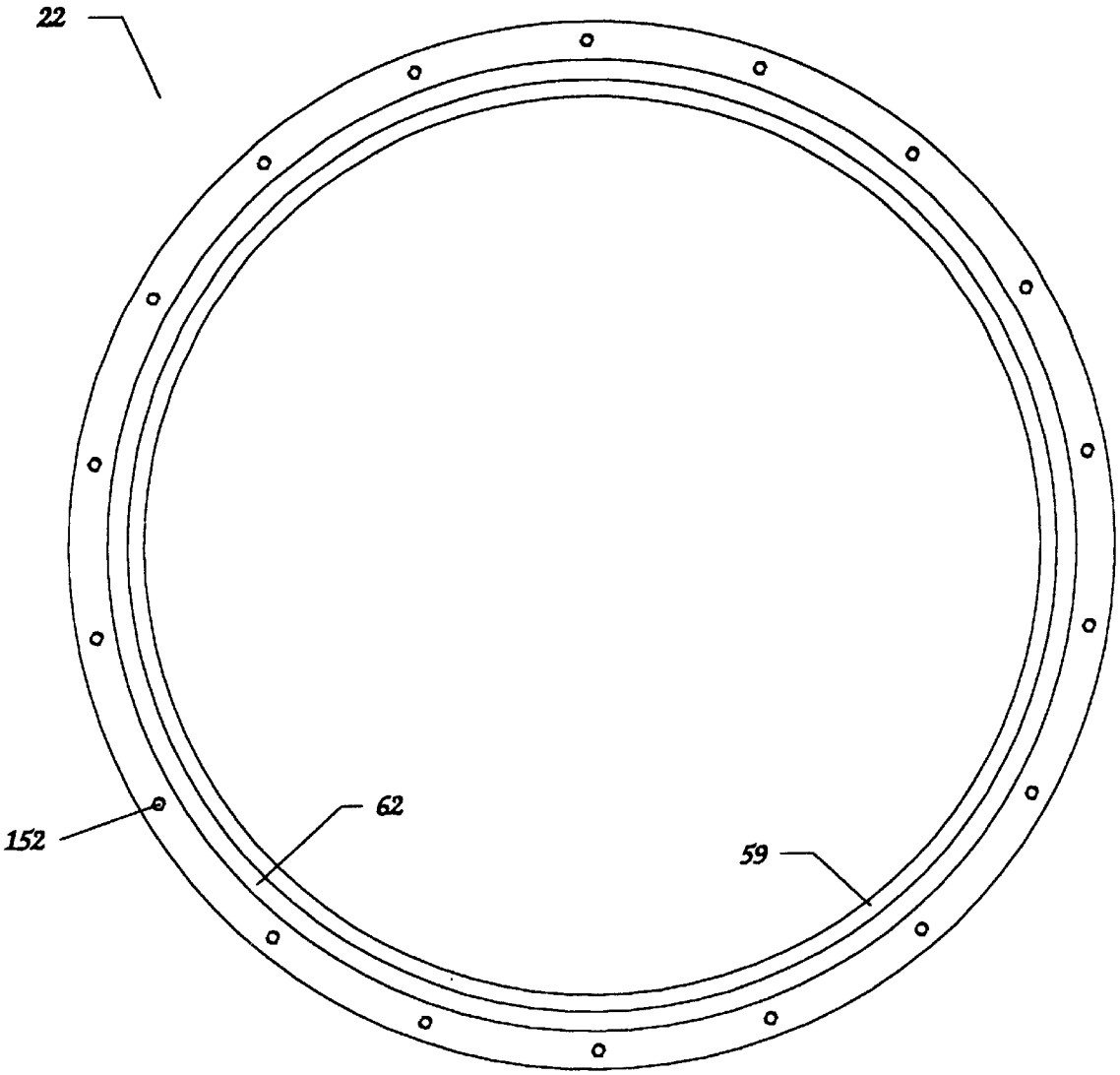
FIG. 5 illustrates, in plan view, a lower housing in accordance with one embodiment of the invention.

FIG. 4 illustrates, in plan view, pressure ring 16 in accordance with one embodiment of the present invention. In this particular embodiment, pressure ring 16 comprises six openings 54, a lip seal landing region 58, an over travel stop 61, and threaded openings 150. Openings 54 align with openings 52 in retaining ring 12. In a preferred embodiment openings 54 extend through pressure ring 16, as shown in FIG. 5. In one embodiment, a portion 55 of openings 54 is threaded to mate with retaining ring fasteners 14. It should be appreciated that pressure ring 16 may have more than or less than six openings 54. In one embodiment, pressure ring 16 is made of stainless steel.

FIG. 5 illustrates, in plan view, lower housing 22 in accordance with one embodiment of the present invention. In this particular embodiment, lower housing 22 comprises threaded openings 152, a lip seal landing region 62, and an over travel stop 59. Threaded openings 152 are used in conjunction with a plurality of fasteners to secure upper housing 32 to lower housing 22. Lower housing 22 is preferably made of stainless steel or a chemically resistant material, such as polyethylene terephthalate or polyphenylene sulfide.

Figure 6:
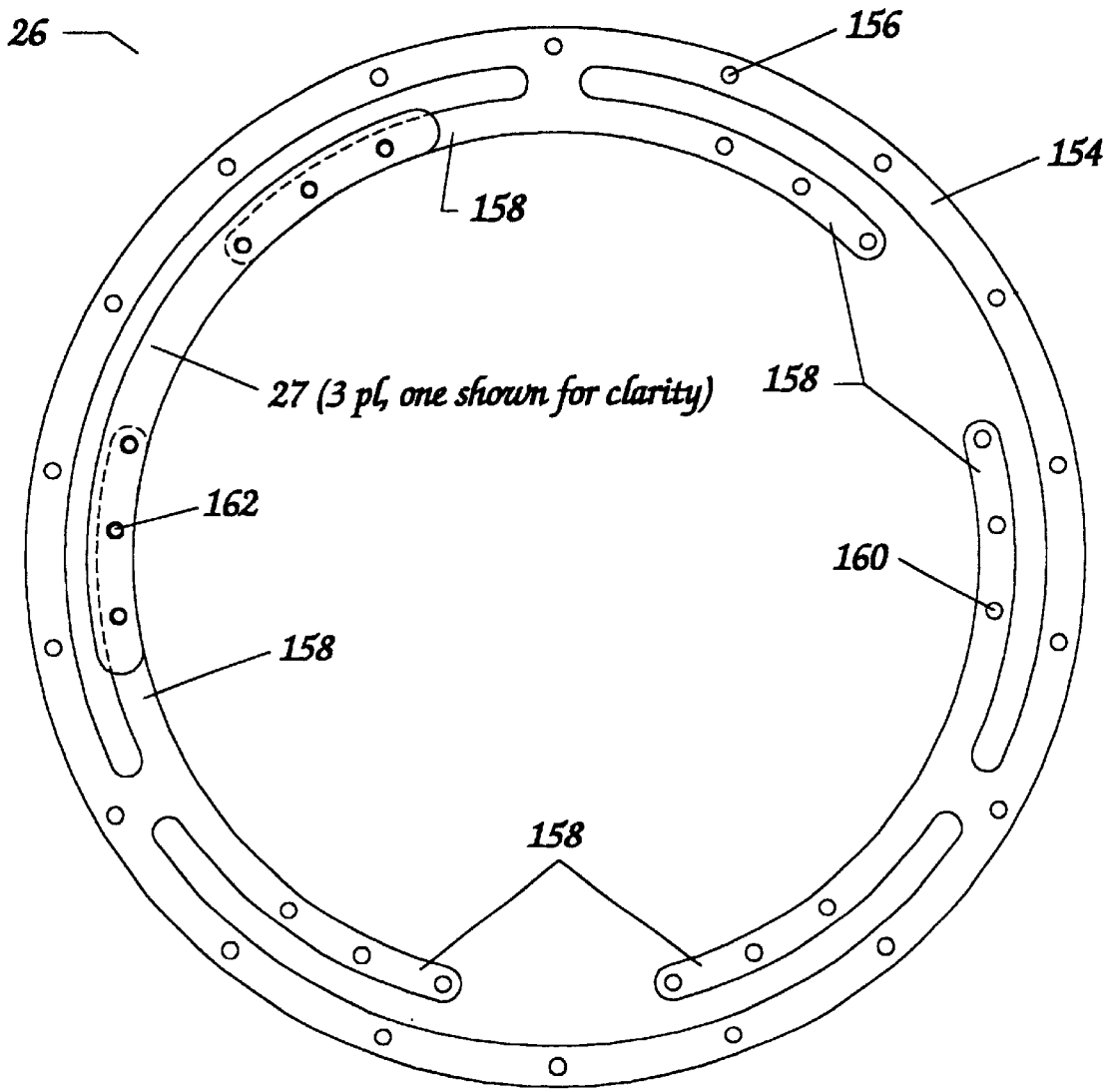
FIG. 6 illustrates, in plan view, a torque flexure in accordance with one embodiment of the invention.

FIG. 6 illustrates, in plan view, torque flexure 26 in accordance with one embodiment of the present invention. In this particular embodiment, torque flexure 26 comprises a first portion 154 having openings 156 formed therein, second portions 158 having openings 160 formed therein, and clamps 27 having openings 162 formed therein. First portion 154 overlies lower housing 22, and openings 156 align with threaded openings 152 of lower housing 22.

When assembled, clamps 27 overlie second portions 158, and openings 160 and openings 162 are aligned to threaded openings 150 of pressure ring 16. Threaded openings 150 are then used in conjunction with a plurality of fasteners to secure pressure ring 16 to clamps 27 and to second portions 158. Note that after assembly, a portion of each clamp 27 slightly overlies a portion of seal 20, as shown in FIG. 2. This overlap between clamps 27 and seal 20 is used to retain seal 20 in position. Clamps 27 are used to attach torque flexure to pressure ring 16 in a manner that distributes torque stresses, but still allow reduced friction vertical motion.

Figure 7:
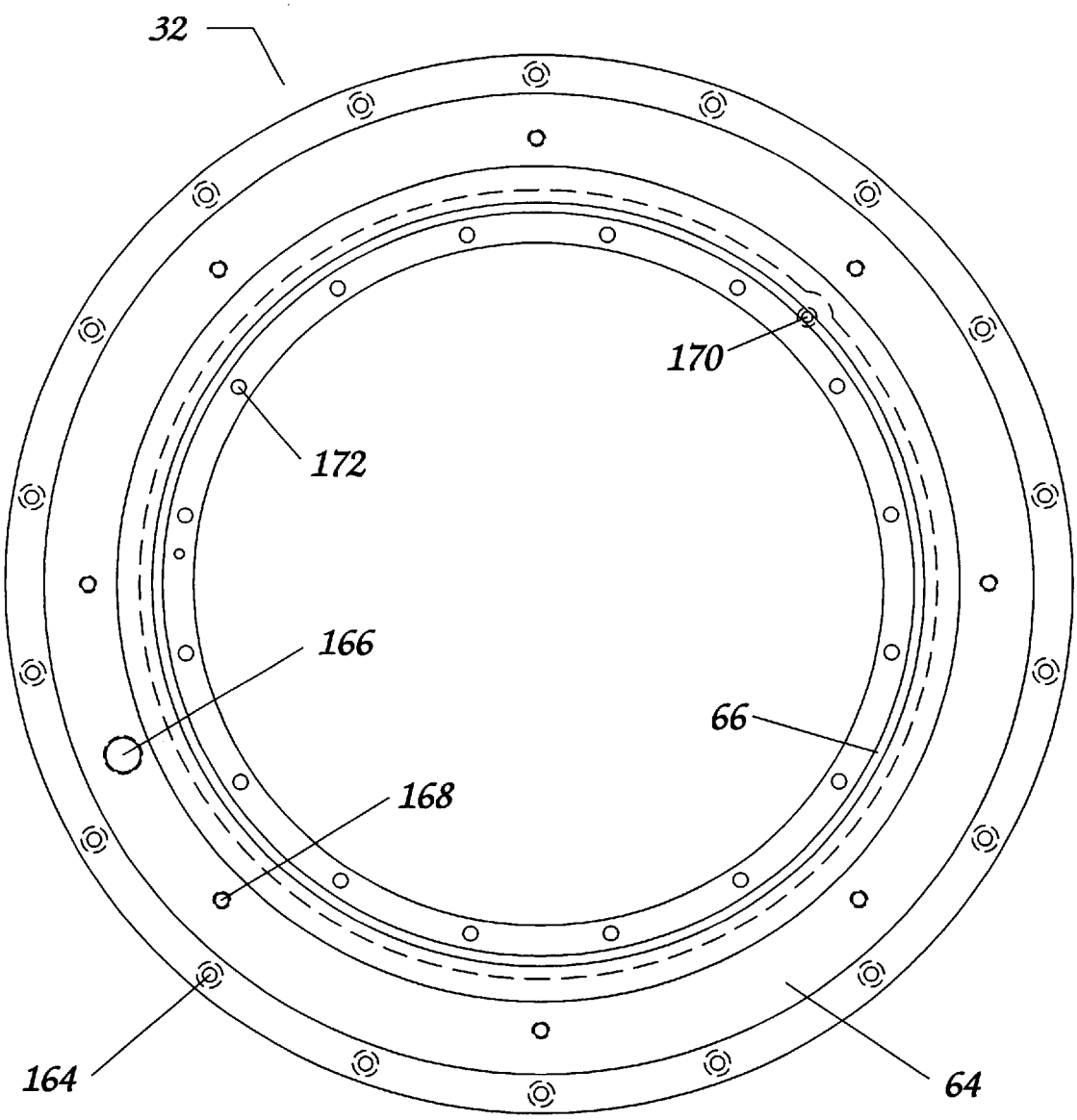
FIG. 7 illustrates, in plan view, an upper housing in accordance with one embodiment of the invention.

FIG. 7 illustrates, in plan view, upper housing 32 in accordance with one embodiment of the present invention. In this particular embodiment, upper housing 32 comprises openings 164, a channel region 64, a fluid inlet 166, threaded openings 168, a channel region 66, a fluid inlet 170, and openings 172. Openings 164 align with threaded openings 152 in lower housing 22, and allow upper housing 32 to be attached to lower housing 22 using a plurality of fasteners. Threaded openings 168 overlie channel region 64 and are used in conjunction with a plurality of fasteners to secure cover plate 48 to upper housing 32. Fluid inlet 166 is connected to channel region 64 and is coupled to fluid line 46, as shown in FIG. 1. Fluid inlet 170 is connected to channel region 66 and is used to supply vacuum and/or positive fluid pressure to process hole openings 68.

Figure 8:
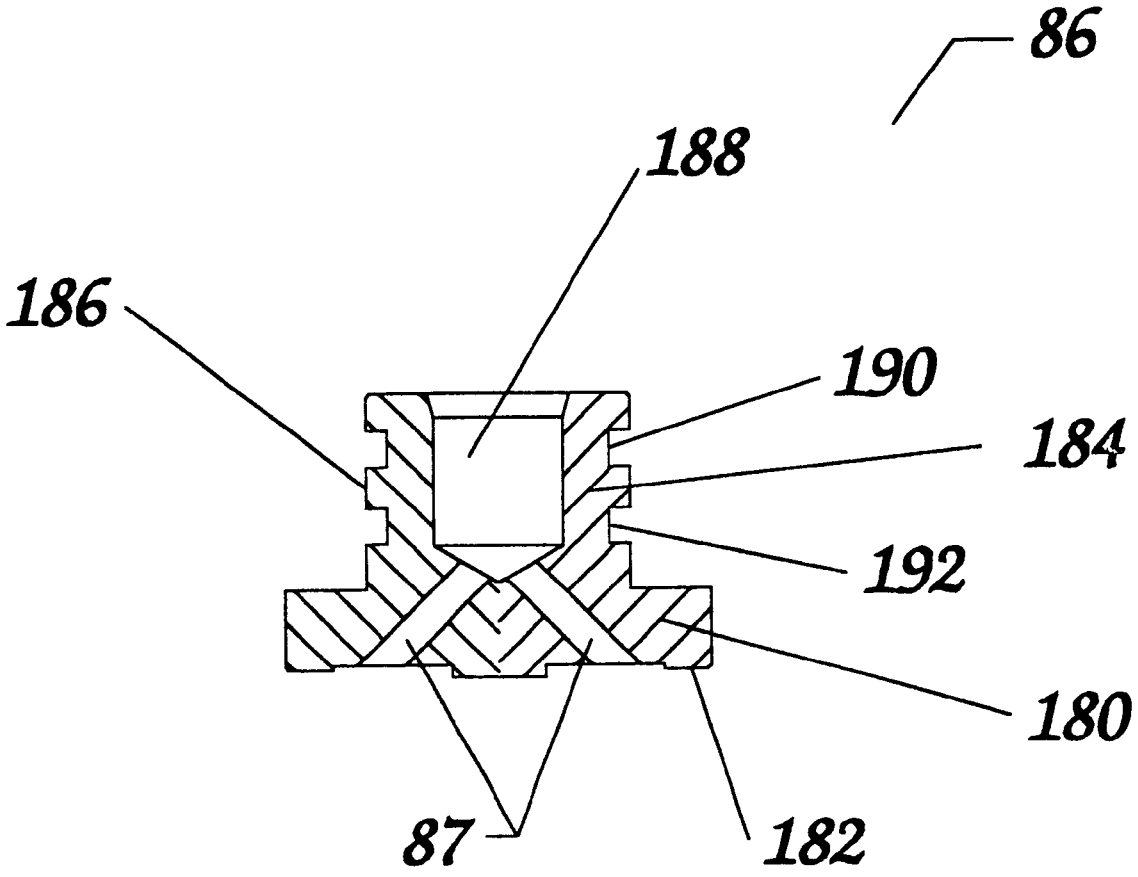
FIG. 8 illustrates, in plan view, a spindle plug in accordance with one embodiment of the invention.

FIG. 8 illustrates, in cross-section, spindle plug 86 in accordance with one embodiment of the present invention. In this particular embodiment, spindle plug 86 comprises a base region 180 having a front surface 182, an insert region 184 having a sidewall 186 and an opening 188, openings 87, a seal region 190, and a seal region 192. Openings 87 extend from the front surface 182 of base region 180 to opening 188 of insert region 184.

Figure 10:
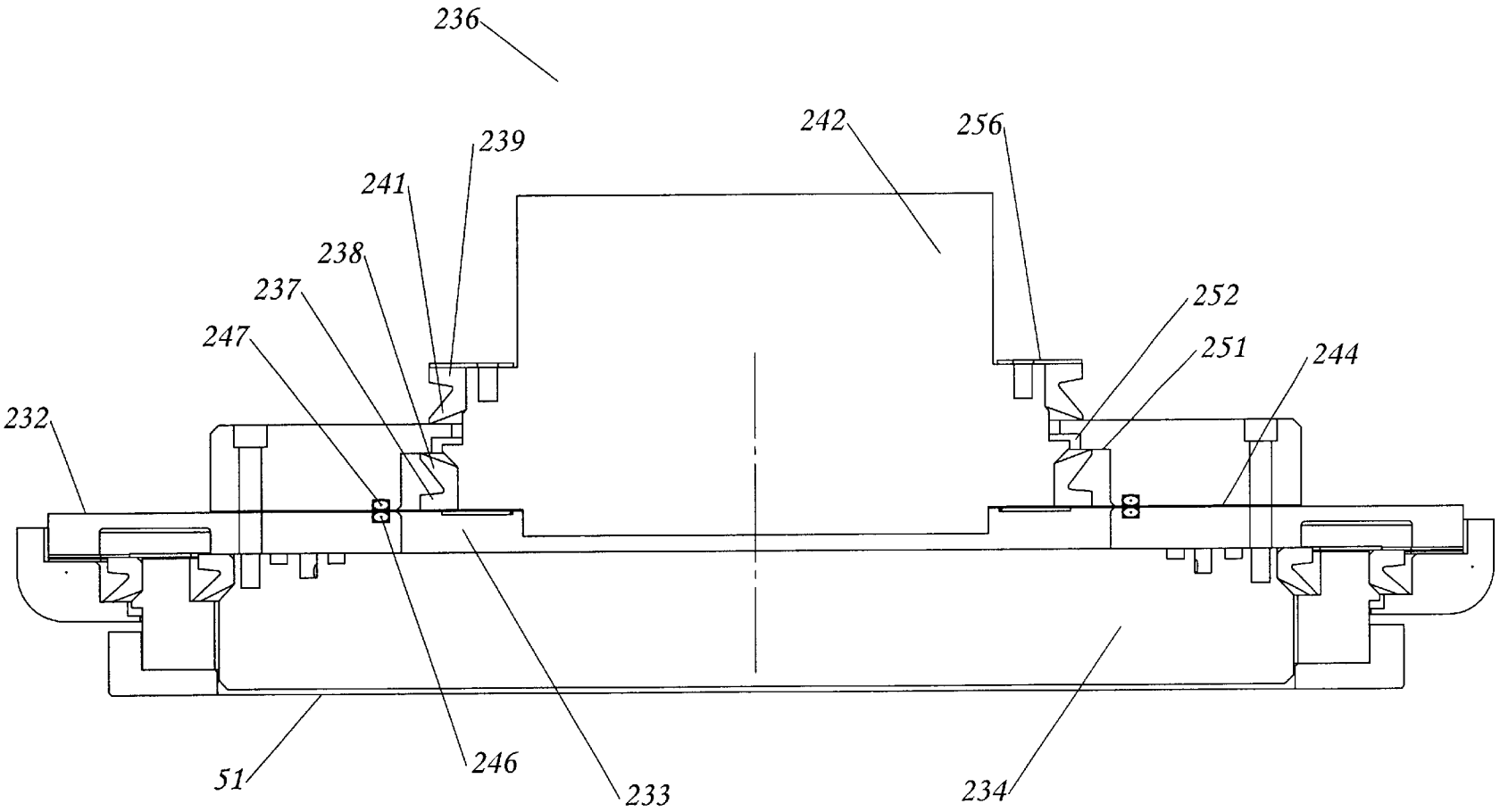
FIG. 10 illustrates, in cross section, a polishing apparatus in accordance with another embodiment of the invention.

In another embodiment, openings 87 intersect opening 188 at a 45 degree angle. Seal region 190 and seal region 192 are formed within a portion of sidewall 186 of insert region 184. In one embodiment, spindle plug 86 comprises four openings 87. It should be appreciated, however, that spindle plug 86 may be formed with more than or less than four openings 87. As shown in FIG. 10, base region 180 has a width that is greater than insert region 184. By having multiple seal regions, like seal regions 190 and 192, a more robust design is provided because the spindle plug is better able to withstand those forces occurring during normal wear that adversely affect uniformity.

FIG. 9 illustrates, in cross section, a portion 15 of polishing apparatus 10. As shown in FIG. 9, rotary fluid coupling 50 is coupled to a portion of spindle shaft 42. Rotary fluid coupling 50 allows fluid pressure to be independently supplied to fluid conduit 104 and fluid conduit 106, while spindle shaft 42 is rotated. In one embodiment, rotary fluid coupling 50 comprises a manifold 108, an annular bearing 110, an annular inlet housing 112, an annular inlet housing 114, an annular bearing 116, a bearing retaining ring 118, and a seal 120. In this particular embodiment, manifold 108 comprises a chamber region 122, an inlet 124 that is coupled to a first portion of chamber region 122, an inlet 126 which is connected to a second portion of chamber region 122, a retaining recess 127 and a retaining shoulder 128.

As shown in FIG. 9, a second end of tube 100 lies within chamber region 122. Seal 102 forms a pressure and/or vacuum seal between tube 100 and manifold 108, and seal 120 forms a pressure and/or vacuum seal between annular spindle housing 80 and manifold 108, such that inlet 124 is coupled only to fluid conduit 104 and inlet 126 is coupled only to fluid conduit 106. Annular bearing 110 overlies retaining shoulder 128 and comprises a bearing 130 and a bearing housing 132. Annular inlet housing 112 overlies annular bearing 110 and comprises a housing 137 having a seal 134 and a seal 136 within an inside surface of housing 137. Housing 137 further has an inlet 138, which is coupled to inlet 126.

Seal 134 and seal 136 form a pressure and/or vacuum seal between manifold 108 and annular inlet housing 112. Annular inlet housing 114 overlies annular inlet housing 112 and comprises, a housing 143 having a seal 140 and a seal 142 within an inside surface of housing 143. Housing 143 further has an inlet 144, which is coupled to inlet 124. Seal 140 and seal 142 form a pressure seal between manifold 108 and annular inlet housing 114.

Annular bearing 116 overlies annular inlet housing 114 and comprises a bearing 146 and a bearing housing 148. Bearing retaining ring 118 overlies annular bearing 116, and a portion of bearing retaining ring 118 lies within retaining ring recess 127. In one embodiment, manifold 108, bearing housing 132, housing 137, housing 143, and bearing housing 148 are made of stainless steel.

Seal 134, seal 136, seal 140, and seal 142 are preferably made of a combination flexible elastomeric material. For example, they may be made of Buna-N nitrile rubber, a fluorelastomer, like that sold under the "Viton" trademark, a plastic material, like that sold under the "Turcon" trademark, or a combination thereof. Seals 134, 136, 140, and 142 may be formed using commercially available seals such as those supplied by a company like Busak-Shamban. Bearing 130 and bearing 146 may be formed using commercially available bearings, such as those sold supplied by a company like Kaydon.

Preferably, annular inlet housings 112 and 114 have the same dimensions (e.g., height, width, etc.) to provide a modular design. Additionally, alignment pins and sockets (not shown) are used to assist in aligning annular inlet housings 112 and 114 and annular bearings 110 and 116. Such a design allows for a multitude of fluid/pneumatic conduit designs using a minimum number of distinct parts in a cost effective manner.

FIG. 10 illustrates, in cross-section view, a polishing apparatus 200, which is in accordance with another embodiment of the present invention. In this embodiment, polishing apparatus 200 is similar to polishing apparatus 10 with the exception of upper housing 232, carrier 234, spindle shaft 242, housing 236, seal 237, torque flexure 244, o-ring seal 246, and o-ring seal 247. Upper housing 232 in conjunction with spindle shaft 242 forms a wafer pressure chamber 233.

Housing 236 includes a lip seal landing region 251 and an over travel stop 252. o-ring seals 246 and 247 provide a mechanical seal around torque flexure 244. Torque flexure 244 functions similarly to torque flexure 26. Seal 237 is a v-shaped seal with a sealing lip 238 that forms a pressure seal with lip seal landing region 251 of housing 236 when positive fluid pressure is applied to sealing lip 238. A positive fluid pressure is provided, for example, through a conduit within spindle shaft 242 (not shown).

Seal 237 allows for a positive pressure within wafer pressure chamber 233, thus transferring primary polishing forces to substrate 51 through carrier 234 in a uniform manner. It should be appreciated that seal 237 may also be a U-shaped seal, a W-shaped seal, a C-shaped seal, an E-shaped seal, or a flap seal. Seal 237 preferably is made of a flexible elastomeric material. For example, seal 237 may be made of Buna-N nitrile rubber or a fluorelastomer, like that sold under the "Viton" trademark. It should be further appreciated that the shape of seal 237 provides a pressure seal as well as a reduced friction motion for polishing apparatus 200 to forcibly apply polishing pressure to substrate 51.

In an optional embodiment, polishing apparatus 200 further includes seal 239, which has a sealing lip 241. Sealing lip 241 is oriented so that a lip seal landing region is formed by housing 236. A clamp 256 is coupled to spindle shaft 242 and holds seal 239 in place. Seal 239 forms a pressure seal with housing 236 when vacuum is applied to wafer pressure chamber 233. This enables polishing apparatus 200 to rapidly remove the polishing pressure from substrate 51 at the end of a polishing step. Seal 239 has similar characteristics to seal 238. Note that seals 237 and 238 are not fixedly attached to housing 236, which reduces membrane or attachment stresses that would adversely affect a uniform pressure distribution.

A method for polishing a semiconductor substrate with polishing apparatus 10, which is in accordance with one embodiment of the invention, will now be briefly described. A layer of material, such as a conductive layer or an dielectric layer, is formed overlying a semiconductor substrate. Polishing apparatus 10 is then placed adjacent to the semiconductor substrate, and polishing apparatus 10 applies a vacuum to the back surface of the semiconductor substrate in order to mount the semiconductor substrate to polishing apparatus 10, in a manner similar to that shown in FIG. 1. Note, fluid conduit 104 is used to apply the vacuum to the back surface of the semiconductor substrate.

The front surface of the semiconductor substrate and the front surface of retaining ring 12 are then placed in contact with a polishing pad. The semiconductor substrate is then rotated by polishing apparatus 10, while the polishing pad is also rotated, and the layer of material is polished to remove at least a portion of it. During polishing, fluid conduit 106 is used to apply a positive fluid pressure to seal 18 and seal 20 in order to form a uniform pressure distribution across retaining ring 12. In one embodiment, pressurized air is applied to seal 18 and seal 20 by fluid conduit 106. Alternatively, fluid conduit 106 may also supply a pressurized inert gas, such as nitrogen, or a pressurized liquid, such as water to seal 18 or seal 20 during polishing.

It is important to note that the unique interaction between seal 18, seal 20, pressure ring 16 and retaining ring 12 and the pressure applied directly to substrate 51 enables a reduced edge exclusion thereby increasing die yield. Moreover, independent control of the pressure across retaining ring 12 and the polishing pressure applied to substrate 51 allows specific control of the pressure differential thereby enabling optimal reductions in edge exclusion.

It should be appreciated that fluid conduit 104 may also be used to apply a positive fluid pressure on the back surface of the semiconductor substrate at the same time that fluid conduit 106 is applying a positive fluid pressure to seal 18 and seal 20. Moreover, since fluid conduit 104 and fluid conduit 106 are independent from each other polishing apparatus 10 may be used to apply one pressure to seal 18 and seal 20, and another pressure to the back surface of the semiconductor substrate. This serves as a supplement to polishing pressure transmitted by shaft 41, and enables back-side pressure tailoring of across wafer polishing uniformity in accordance with standard practices. For example, fluid conduit 106 may be used to apply a higher pressure to seal 18 and seal 20, than fluid conduit 104 applies to the semiconductor surface. Similarly, fluid conduit 106 may be used to apply a lower pressure to seal 18 and seal 20, than fluid conduit 104 applies to the semiconductor surface. In addition, fluid conduit 106 may apply the same or greater pressure to seal 18 and seal 20, that fluid conduit 104 applies to the semiconductor surface.

Thus it is apparent that there has been provided, in accordance with the present invention, a polishing apparatus and a method for polishing a semiconductor substrate with the polishing apparatus that fully meets the need and advantages set forth previously. Although the invention has been described and illustrated with reference to specific embodiments thereof, it is not intended that the invention be limited to these illustrative embodiments. Those skilled in the art will recognize that modifications and variations can be made without departing from the spirit of the invention. Therefore, it is intended that this invention encompass all such variations and modifications as fall within the scope of the appended claims.

What is claimed:

1. A polishing apparatus comprising:

a pressure ring, the pressure ring comprising a first lip seal landing region;

a retaining ring attached to the pressure ring and underlying the pressure ring;

a carrier adjacent to the retaining ring and the pressure ring, a first seal having a first sealing lip, wherein the first sealing lip forms a first pressure seal with the first lip seal landing region when a first positive fluid pressure is applied to the first sealing lip;

a first housing adjacent the pressure ring, the first housing comprising a second lip seal landing region; and a second seal having a second sealing lip, wherein the second sealing lip forms a second pressure seal with the second lip seal landing region when the first positive fluid pressure is applied to the second sealing lip.

2. The polishing apparatus of claim 1, wherein the retaining ring is movably attached to the pressure ring.

3. The polishing apparatus of claim 2, wherein the retaining ring is movably attached to the pressure ring using a headless fastener.

4. The polishing apparatus of claim 1, further comprising a spindle shaft, wherein the spindle shaft comprises a first conduit and a second conduit, and wherein the second conduit provides the first positive fluid pressure to the first seal and the second seal.

5. The polishing apparatus of claim 4, wherein the first conduit is coaxial with the second conduit.

6. The polishing apparatus of claim 4, wherein the carrier is further characterized as having a process opening.

7. The polishing apparatus of claim 6, wherein the first conduit provides vacuum to the process opening.

8. The polishing apparatus of claim 6, wherein the first conduit provides a second positive fluid pressure to the process opening.

9. The polishing apparatus of claim 8 further comprising:

a second housing having a first chamber, wherein the first chamber overlies at least a portion of the carrier;

a third housing adjacent the second housing, the third housing having a third lip seal landing region; and a third seal having a third sealing lip, wherein the third sealing lip forms a third pressure seal with the third lip seal landing region when the second positive fluid pressure is applied to the third sealing lip.

10. The polishing apparatus of claim 9 further comprising a fourth seal having a fourth sealing lip, wherein the fourth sealing lip is adjacent the third housing, and wherein the fourth sealing lip forms a fourth pressure seal with the third housing when a first negative pressure is applied to the first chamber.

11. The polishing apparatus of claim 4, further comprising a rotary fluid coupling attached to the spindle shaft, wherein the rotary fluid coupling comprises a first inlet coupled to the first conduit, and a second inlet coupled to the second conduit.

12. The polishing apparatus of claim 11 wherein the rotary fluid coupling is modular.

13. The polishing apparatus of claim 4, wherein the spindle shaft further comprises a spindle plug and a spindle housing, wherein the spindle plug is sealed against a portion of the spindle housing using a first seal and a second seal.

14. The polishing apparatus of claim 1, further comprising a second housing having a first chamber formed therein, wherein the first chamber overlies at least a portion of the first seal and at least a portion of the second seal.

15. The polishing apparatus of claim 1, wherein the first seal and the second seal are further characterized as V-shaped seals.

16. The polishing apparatus of claim 1, wherein the first seal and the second seal are selected from a group consisting of a V-shaped seal, a U-shaped seal, a W-shaped seal, an E-shaped seal, and a C-shaped seal.

17. The polishing apparatus of claim 1, wherein the first seal is further characterized as a flap seal.

18. A polishing apparatus comprising:

a retaining ring, the retaining ring comprising a first lip seal landing region;

a carrier adjacent to the retaining ring;

a first seal having a first sealing lip, wherein the first sealing lip forms a first pressure seal with the first lip seal landing region when a first positive fluid pressure is applied to the first sealing lip;

a first housing adjacent the retaining ring, the first housing comprising a second lip seal landing region; and a second seal having a second sealing lip, wherein the second sealing lip forms a second pressure seal with the second lip seal landing region when the first positive fluid pressure is applied to the second sealing lip.

19. The polishing apparatus of claim 18, further comprising a spindle shaft, wherein the spindle shaft comprises a first conduit and a second conduit, and wherein the second conduit provides the first positive fluid pressure to the first seal and the second seal.

20. The polishing apparatus of claim 19, wherein the first conduit is coaxial with the second conduit.

21. The polishing apparatus of claim 19, wherein the carrier is further characterized as having a process opening.

22. The polishing apparatus of claim 21, wherein the first conduit provides vacuum to the process opening.

23. The polishing apparatus of claim 21, wherein the first conduit provides a second positive fluid pressure to the process opening.

24. The polishing apparatus of claim 19, further comprising a rotary fluid coupling attached to the spindle shaft, wherein the rotary fluid coupling comprises a first inlet coupled to the first conduit, and a second inlet coupled to the second conduit.

25. The polishing apparatus of claim 19, wherein the spindle shaft further comprises a spindle plug and a spindle housing, wherein the spindle plug is sealed against a portion of the spindle housing using a first seal and a second seal.

26. The polishing apparatus of claim 18, further comprising a second housing having a chamber formed therein, wherein the chamber overlies at least a portion of the first seal and at least a portion of the second seal.

27. The polishing apparatus of claim 18, wherein the first seal and the second seal are further characterized as V-shaped seals.

28. The polishing apparatus of claim 18, wherein the first seal and the second seal are selected from a group consisting of a V-shaped seal, a U-shaped seal, a W-shaped seal, an E-shaped seal, and a C-shaped seal.

29. The polishing apparatus of claim 18, wherein the first seal is further characterized as a flap seal.

30. A method for polishing a layer of material overlying a semiconductor substrate comprising the steps of:

providing the semiconductor substrate, the semiconductor substrate having a back surface;

forming the layer of material overlying the semiconductor substrate;

providing a polishing apparatus, the polishing apparatus comprising a pressure ring, the pressure ring comprising a first lip seal landing region;

a retaining ring attached to the pressure ring and underlying the pressure ring;

a carrier adjacent to the retaining ring and the pressure ring;

a first seal having a first sealing lip, wherein the first sealing lip forms a first pressure seal with the first lip seal landing region when a first positive fluid pressure is applied to the first sealing lip;

a first housing adjacent the pressure ring, the housing comprising a second lip seal landing region; and a second seal having a second sealing lip, wherein the second sealing lip forms a second pressure seal with the second lip seal landing region when the first positive fluid pressure is applied to the second sealing lip;

mounting the semiconductor substrate to the carrier; and polishing the layer of material overlying the semiconductor substrate to remove at least a portion of the layer of material, wherein the first positive fluid pressure is applied to the first sealing lip and the second sealing lip when the layer of material is polished.

31. The method of claim 30 further comprising the step of applying a second positive fluid pressure to the back surface of the semiconductor substrate, wherein the second positive pressure is different than the first positive fluid pressure.

32. The method of claim 30, wherein the layer of material is further characterized as one of a dielectric layer and a conductive layer.

33. The method of claim 30, wherein the polishing apparatus further comprises a spindle shaft, and wherein the spindle shaft comprises a first conduit and a second conduit, and the second conduit provides the first positive fluid pressure to the first seal and the second seal.

34. The method of claim 33, wherein the polishing apparatus further comprises:

a second housing having a first chamber, wherein the first chamber overlies at least a portion of the carrier;

a third housing adjacent the second housing, the third housing having a third lip seal landing region; and a third seal having a third sealing lip, wherein the third sealing lip forms a third pressure seal with the third lip seal landing region when the second positive fluid pressure is applied to the third sealing lip.

35. The method of claim 34, wherein the polishing apparatus further comprises a fourth seal having a fourth sealing lip, wherein the fourth sealing lip is adjacent the third housing, and wherein the fourth sealing lip forms a fourth pressure seal with the third housing when a first negative pressure is applied to the first chamber.

36. The method of claim 33, wherein the step of polishing the layer of material, the first conduit provides a second positive fluid pressure to the back surface of the semiconductor substrate.

37. The method of claim 36, wherein the first positive fluid pressure is greater than the second positive fluid pressure.

38. The method of claim 36, wherein the first positive fluid pressure is less than the second positive fluid pressure.

39. The method of claim 30, wherein the polishing apparatus further comprises a spindle shaft, and wherein the spindle shaft comprises a first conduit and a second conduit, and the first conduit and the second conduit are coaxial.

40. The method of claim 30 wherein the retaining ring is movably attached to the pressure ring.

41. The method of claim 40, wherein the polishing apparatus further comprises a spindle shaft, and wherein the spindle shaft comprises a first conduit and a second conduit, and the second conduit provides the first positive fluid pressure to the first seal and the second seal.

42. The method of claim 41, wherein the step of polishing the layer of material, the first conduit provides a second positive fluid pressure to the back surface of the semiconductor substrate.

43. A method for polishing a layer of material overlying a semiconductor substrate comprising the steps of:

providing the semiconductor substrate; forming the layer of material overlying the semiconductor substrate;

providing a polishing apparatus, the polishing apparatus comprising a retaining ring, the retaining ring comprising a first lip seal landing region;

a carrier adjacent to the retaining ring;

a first seal having a first sealing lip, wherein the first sealing lip forms a first pressure seal with the first lip seal landing region when a first positive fluid pressure is applied to the first sealing lip;

a housing adjacent the retaining ring, the housing comprising a second lip seal landing region; and a second seal having a second sealing lip, wherein the second sealing lip forms a second pressure seal with the second lip seal landing region when the first positive fluid pressure is applied to the second sealing lip;

mounting the semiconductor substrate to the carrier;

polishing the layer of material to remove at least a portion of the layer of material, wherein the first positive fluid pressure is applied to the first sealing lip and the second sealing lip when the layer of material is polished.

* * * * *